US006650856B2

(12) United States Patent
Ahn et al.

(10) Patent No.: US 6,650,856 B2
(45) Date of Patent: Nov. 18, 2003

(54) LIQUID ELECTROPHOTOGRAPHIC PRINTER AND PRINTING METHOD

(75) Inventors: Hyeong-jin Ahn, Suwon-si (KR); Cheol-young Han, Yongin-si (KR); Woo-yong Park, Suwon-si (KR); Seung-young Byun, Seongnam-si (KR); Myung-ho Kyung, Suwon-si (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/953,290

(22) Filed: Sep. 17, 2001

(65) Prior Publication Data

US 2002/0136569 A1 Sep. 26, 2002

(30) Foreign Application Priority Data

Feb. 6, 2001 (KR) ..... 2001-5632

(51) Int. Cl.[7] ..... G03G 15/10
(52) U.S. Cl. ..... 399/237; 399/249
(58) Field of Search ..... 399/237, 238, 399/239, 240, 57, 249, 250, 251

(56) References Cited

U.S. PATENT DOCUMENTS 5,918,093 A * 6/1999 Kim ..... 399/237
6,324,368 B1 * 11/2001 Seto ..... 399/249

FOREIGN PATENT DOCUMENTS

JP 63-191161 * 8/1988
JP 1-109365 * 4/1989

* cited by examiner

*Primary Examiner*—Quana M. Grainger
(74) *Attorney, Agent, or Firm*—Sughrue Mion, PLLC

(57) ABSTRACT

A liquid electrophotographic printer employs a continuously circulating photoreceptor web having a non-image region with a potential higher than an image region. A laser scanner forms a latent electrostatic image in the image region, and a development unit develops the latent image using an ink having toner particles dispersed in a liquid carrier. The development unit includes a developer roller with a surface potential in between that of the image and non-image region for forming the toner image by attaching the toner particles to the image region; a toner removal roller with a surface potential between that of the image and non-image regions after they pass through the developer roller, for removing toner particles remaining in a liquid carrier film in the non-image region; and a squeeze roller with a surface potential higher than any of the foregoing, for squeezing the liquid carrier out of the toner image by compression.

20 Claims, 6 Drawing Sheets

LIQUID ELECTROPHOTOGRAPHIC PRINTER AND PRINTING METHOD

BACKGROUND OF THE INVENTION

1. Field of the Invention

The present invention relates to a liquid electrophotographic printer, and more particularly, to a liquid electrophotographic printer having a development system that includes three rollers.

2. Description of the Related Art

Electrophotographic printers such as laser printers output a desired image by forming a latent electrostatic image on a photoreceptor medium such as a photoreceptor drum or photoreceptor web, developing the latent electrostatic image with a predetermined color toner, and transferring the toner image to a print paper. Electrophotographic printers are classified into a dry type or liquid type according to the toner used. The liquid type printer uses an ink containing a volatile liquid carrier and toner particles in a predetermined ratio to implement a color image with excellent print quality. The dry type printer uses toner in a powder form.

FIG. 1 shows a conventional liquid electrophotographic printer, which uses a photoreceptor web 10 as a photoreceptor medium. The photoreceptor web 10 circulates around a continuous path by being supported by three rollers 11, 12 and 13, and a main charger 20 is provided adjacent to the photoreceptor web 10 to uniformly charge the photoreceptor web 10 to a predetermined potential. Laser scanning units (LSUs) 30*a*, 30*b*, 30*c* and 30*d* for emitting light beams onto the charged photoreceptor web 10 to form a latent electrostatic image, and development units 40*a*, 40*b*, 40*c* and 40*d* for developing the latent electrostatic image as a toner image with a predetermined color ink are provided below the photoreceptor web 10. The conventional liquid electrophotographic printer includes a drying unit 50 for drying the developed image, a transfer unit 60 for printing the dried image on a print paper P, and an eraser 70 for removing the remaining latent electrostatic image from the surface of the photoreceptor web 10. For a color printer, the four development units 40*a*, 40*b*, 40*c*, and 40*d* for sequentially developing four color toner images of yellow (Y), cyan (C), magenta (M), and black (K), respectively, to implement a multi-color image are provided. The four LSUs 30*a*, 30*b*, 30*c*, and 30*d* are provided corresponding to the number of the development units.

The drying unit 50 includes a drying roller 51 which rotates in contact with the photoreceptor web 10 and absorbs the liquid carrier from the surface of the photoreceptor web 10, and a heat roller 52 for evaporating the liquid carrier absorbed by the surface of the drying roller 51 by heating.

The transfer unit 60 includes a transfer roller 61 which rotates in contact with the photoreceptor web 10 and transfers the toner image formed on the surface of the photoreceptor web 10 to the print paper P, and a fusing roller 63 for hot pressing the print paper against the transfer roller 61. Reference numerals 62 and 64 are cleaning rollers for cleaning the transfer roller 61 and the fusing roller 63, respectively.

The four development units 40*a*, 40*b*, 40*c*, and 40*d* are arranged below the photoreceptor web 10 in series in a circulation direction of the photoreceptor web 10. In a lower portion of the development units 40*a*, 40*b*, 40*c* and 40*d*, ink reservoirs 80*a*, 80*b*, 80*c* and 80*d* which contain Y, C, M, and K inks, are provided, respectively. In the inks contained in the ink reservoirs 80*a*, 80*b*, 80*c* and 80*d*, toner particles are mixed with a pure liquid carrier in a concentration amount of 2.5–3% solution by weight.

The structure of the development units 40*a*, 40*b*, 40*c*, and 40*d* will be described with reference to the development unit 40*a* for developing a yellow (Y) toner image, referred to herein as a Y-development unit. Referring to FIG. 2, a developer roller 41, a squeeze roller 43 and a topping corona 45 are installed in the upper portion of the Y-development unit 40*a*. An ink supply nozzle 49 for supplying an ink to the gap between the photoreceptor web 10 and the developer roller 41 is installed adjacent to the developer roller 41. A cleaning roller 47 is installed underneath the developer roller 41. A cleaning blade 48 is affixed to the lower portion of the squeeze roller 43. The developer roller 41 serves to make the ink adhere to a latent electrostatic image region of the photoreceptor web 10. The squeeze roller 43 squeezes the liquid carrier out of the ink adhering to the photoreceptor web 10. The topping corona 45 recharges the photoreceptor web 10 to a predetermined potential for development of another color image. The cleaning roller 47 and blade 48 are used for removing the excessive ink or liquid carrier remaining on the surface of the developer roller 41 and the squeeze roller 43, respectively.

A development system of the conventional liquid electrophotographic printer having the configuration described above will now be described in greater detail.

The photoreceptor web 10 is charged to a potential of about 650 volts by the main charger 20. The Y-LSU 30*a* emits a beam onto the charged surface of the photoreceptor web 10 to form a latent electrostatic image of Y color. The Y-LSU 30*a* selectively erases the surface potential of the photoreceptor web 10 to form a latent electrostatic image, so that the potential of an image region in which a latent electrostatic image is formed drops to about 100 volts or less.

The latent electrostatic image is developed into a Y-image by the Y-development unit 40*a*. In particular, the surface of the developer roller 41 is charged to a potential $V_D$ of about 500 volts, and the developer roller 41 rotates in a circulation direction of the photoreceptor web 10 with a development gap G of 100–200 $\mu$m from the photoreceptor web 10. When a Y-ink is supplied into the gap between the photoreceptor web 10 and the developer roller 41 by the ink supply nozzle 49, a nip N having about 6-mm width is formed between the photoreceptor web 10 and the developer roller 41. The toner particles contained in the ink are generally charged to a positive potential. Thus, toner particles selectively adhere to an image region B having a potential relatively lower than that in a non-image region A in which no latent electrostatic image is formed, so that a high-concentration toner image is developed.

During this development process, excess ink adhering to the surface of the rotating developer roller 41 is removed by the cleaning roller 47. The squeeze roller 43 squeezes the liquid carrier out of the developed toner image region by compression, so that a toner image having a concentration of about 50% is formed in the image region B of the photoreceptor web 10 passed through the squeeze roller 43. The liquid carrier squeezed by the squeeze roller 43 is also removed from the surface of the squeeze roller 43 by the cleaning blade 48. The ink and liquid carrier removed by the cleaning roller 47 and blade 48 is recovered into the ink reservoir 80*a*.

After the Y-image is developed, the photoreceptor web 10 is charged again to a predetermined potential by the topping corona 45 for development of a next color image, i.e., a C-image. The C-LSU 30*b* emits a light beam onto the surface of the photoreceptor web 10 to form a latent electrostatic image of C color. The latent electrostatic image is developed into a C-toner image by the C-development unit 40*b*.

As described above, the images of four colors are sequentially developed in the order of Y, C, M, and K, so that a full color image is formed. The developed color image is dried in the drying unit 50 to the extent of appropriately performing a subsequent transfer process, and in turn transferred to the print paper P in the transfer unit 60.

However, the conventional liquid electrophotographic printer which operates with the configuration, as described above, has the following problems.

First, two layers are formed on the surface of the photoreceptor web 10 passed through the developer roller 41, including a high-concentration ink layer adhering to the image region B, and a liquid carrier layer covering the non-image region A and the ink layer. Here, no toner particles should exist in the liquid carrier layer. However, it is difficult to completely remove toner particles from the liquid carrier layer, and thus actually about 0.5% toner particles exist in the liquid carrier. Accordingly, even after the liquid carrier is mostly removed by the squeeze roller 43, a thin liquid carrier film containing toner particles remains in the non-image region A of the photoreceptor web 10. As the photoreceptor web 10 circulates, the toner particles in the thin liquid carrier film are carried into the C-development unit 40*b* and are mixed with toner particles of another color. As a result, the C-development unit 40*b*, M-development unit 40*c*, and K-development unit 40*d* arranged in the order, and the inks contained in the development units are sequentially contaminated. In addition, toner particles remaining in the non-image region A are also transferred to the print paper P in the transfer unit 60, so that the non-image region of the print paper P is smeared.

Second, when the liquid carrier is squeezed out of the image region B of the photoreceptor web 10 by the squeeze roller 43, a part of the image may adhere to the surface of the squeeze roller 43 by compression force applied to the image region B of the photoreceptor web 10. In this case, the part of the image remaining on the surface of the squeeze roller 43 may be transferred onto a next color image.

Third, when the liquid carrier is squeezed out of the image region B of the photoreceptor web 10 by the squeeze roller 43, the image formed in the image region B is compressed and thus forced beyond its intended edge, so that it extends into the neighboring non-image region or other color image regions.

The problems described above degrade the overall quality of color images.

SUMMARY OF THE INVENTION

To solve the problems of the prior art, it is an aspect of the present invention to provide a liquid electrophotographic printer adopting a development system including three rollers, one of which is a toner removal roller, in which contamination of a development unit is prevented and image quality improved.

To achieve the foregoing aspect of the present invention, there is provided a liquid electrophotographic printer comprising: a photoreceptor web circulating around a continuous path, having a non-image region charged by a main charger to a first potential and an image region in which a latent electrostatic image is formed by a laser scanning unit to have a second potential, wherein the second potential is lower than the first potential; a development unit for developing the latent electrostatic image using an ink in which toner particles of a predetermined color are dispersed in a liquid carrier; a drying unit for drying a developed toner image; and a transfer unit for transferring a dried image to a print paper, wherein the development unit comprises: a developer roller rotatably installed with a predetermined separation gap from the photoreceptor web, for forming the toner image by attaching the toner particles of the ink to the image region; a toner removal roller rotatably installed with a predetermined separation gap from the photoreceptor web, for removing toner particles remaining in a liquid carrier film adhering to the non-image region; and a squeeze roller rotatably installed in contact with the photoreceptor web, for squeezing the liquid carrier out of the toner image by compressing the toner image.

In one embodiment, the surface of the developer roller is charged to a third potential whose level is between the first and second potentials. In this case, preferably, the third potential is at least 100 volts lower than the first potential.

In another embodiment, the surface of the toner removal roller is charged to a fourth potential whose level is between the potential of the non-image region passed through the developer roller and the potential of the image region passed through the developer roller. Preferably, the fourth potential is at least 50 volts lower than the potential of the non-image region passed through the developer roller. Preferably, the toner removal roller rotates in a direction opposite to a circulation direction of the photoreceptor web.

In still another embodiment, the surface of the squeeze roller is charged to a fifth potential whose level is higher than the first potential so as to recharge the surface of the photoreceptor web to a predetermined potential. Preferably, the squeeze roller is formed of a resistive material having a resistance of $10^5$–$10^9$ Ω.

Further, a method utilizing the above described apparatus is employed to overcome the problems evident in the prior art.

Thus, according to the present invention, contamination of the development unit and the inks is prevented and image quality is improved.

BRIEF DESCRIPTION OF THE DRAWINGS

The above aspect and advantages of the present invention will become more apparent by describing in detail exemplary embodiments thereof with reference to the attached drawings in which.

DETAILED DESCRIPTION OF THE INVENTION

Figure 3:
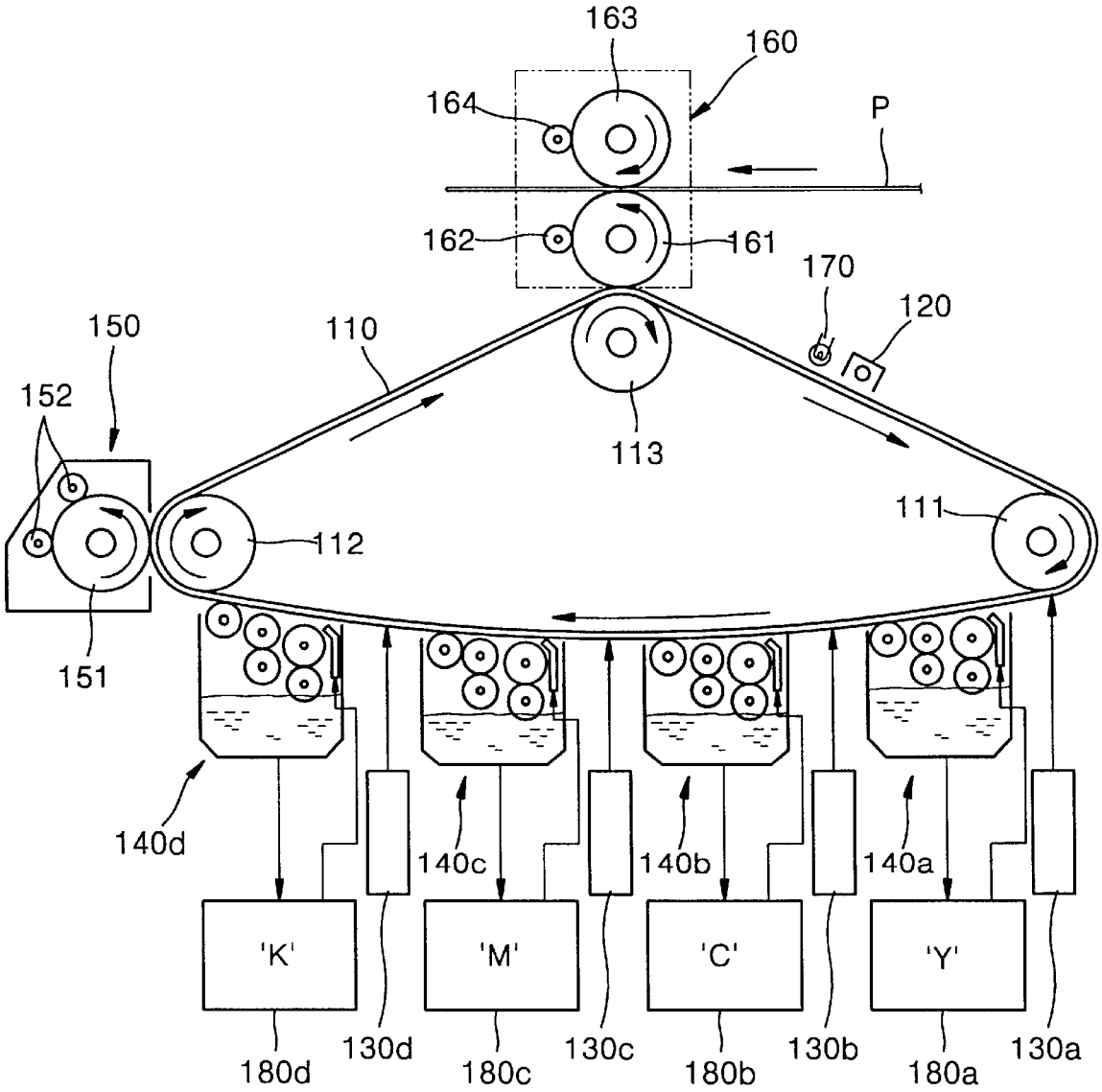
FIG. 3 is a schematic diagram showing the structure of the main parts of a liquid electrophotographic printer according to the present invention.

An exemplary embodiment of a liquid electrophotographic printer according to the present invention will be described in greater detail with reference to the appended drawings. The main elements of a liquid electrophotographic printer according to the present invention are shown in FIG. 3. Referring to FIG. 3, the liquid electrophotographic printer uses a photoreceptor web 110 as a photoreceptor medium. When the photoreceptor medium in the form of a belt is used, a color image is implemented by sequentially forming overlapping multiple color images. The multiple color images are simultaneously transferred to a printer paper P through a single transfer process. Thus, the print speed of the liquid electrophotographic printer is faster than an electrophotographic printer using a drum-type photoreceptor medium and the image quality is also better.

The photoreceptor web 110 circulates around a continuous path and is supported by three rollers 111, 112 and 113, including a driving roller and a steering roller. A main charger 120 is provided adjacent to the photoreceptor web 110 to uniformly charge the photoreceptor web 110 to a predetermined potential.

Laser scanning units (LSUs) 130*a*, 130*b*, 130*c* and 130*d* for emitting light beams onto the charged photoreceptor web 110 to form a latent electrostatic image, and development units 140*a*, 140*b*, 140*c* and 140*d* for developing the latent electrostatic image as a toner image with a predetermined color ink are provided below the photoreceptor web 110. For a color printer, four development units 140*a*, 140*b*, 140*c* and 140*d* for sequentially developing overlapping four color toner images of yellow (Y), cyan (C), magenta (M), and black (K), respectively, are provided to implement a multicolor image. The four LSUs 130*a*, 130*b*, 130*c* and 130*d* are also provided for forming latent images of each respective color. The four development units 140*a*, 140*b*, 140*c* and 140*d* are arranged below the photoreceptor web 110 in series in a circulation direction of the photoreceptor web 110. In a lower portion of the development units 140*a*, 140*b*, 140*c* and 140*d*, ink reservoirs 180*a*, 180*b*, 180*c* and 180*d* are provided. Ink reservoirs 180*a*, 180*b*, 180*c* and 180*d* contain Y, C, M, and K inks, respectively. In the inks contained in the ink reservoirs 180*a*, 180*b*, 180*c* and 180*d*, toner particles are dispersed in a pure liquid carrier in a concentration amount of about 2.0–3%, preferably 2.5%, by weight. The inks having an appropriate conductivity are prepared. This will be described later. The four color images may be developed in the order of Y, M, C, and K.

The developed image is dried by the drying unit 150 to the extent that a subsequent transfer process can be appropriately performed. The drying unit 150 includes a drying roller 151 which rotates in contact with the photoreceptor web 110 and absorbs the liquid carrier from the surface of the photoreceptor web 110, and a heat roller 152 for evaporating the liquid carrier absorbed by the surface of the drying roller 151 by heating.

The liquid electrophotographic printer includes a transfer unit 160 for printing the dried image on a print paper P. The transfer unit 160 includes a transfer roller 161 which rotates in contact with the photoreceptor web 110 and transfers the toner image formed on the surface of the photoreceptor web 110 to the print paper P, and a fusing roller 163 for hot pressing the print paper against the transfer roller 161. Reference numerals 162 and 164 are cleaning rollers for cleaning the transfer roller 162 and the fusing roller 163, respectively.

An eraser 170 for removing the remaining latent electrostatic image from the surface of the photoreceptor web 110 may be provided.

The main feature of the present invention is the structure of the development units 140*a*, 140*b*, 140*c*, and 140*d*. The four development units 140*a*, 140*b*, 140*c*, and 140*d* have the same structure, and the structure of the development units 140*a*, 140*b*, 140*c*, and 140*d* will be described in greater detail with reference to the Y-development unit 140*a* for developing a Y-image.

Figure 1:
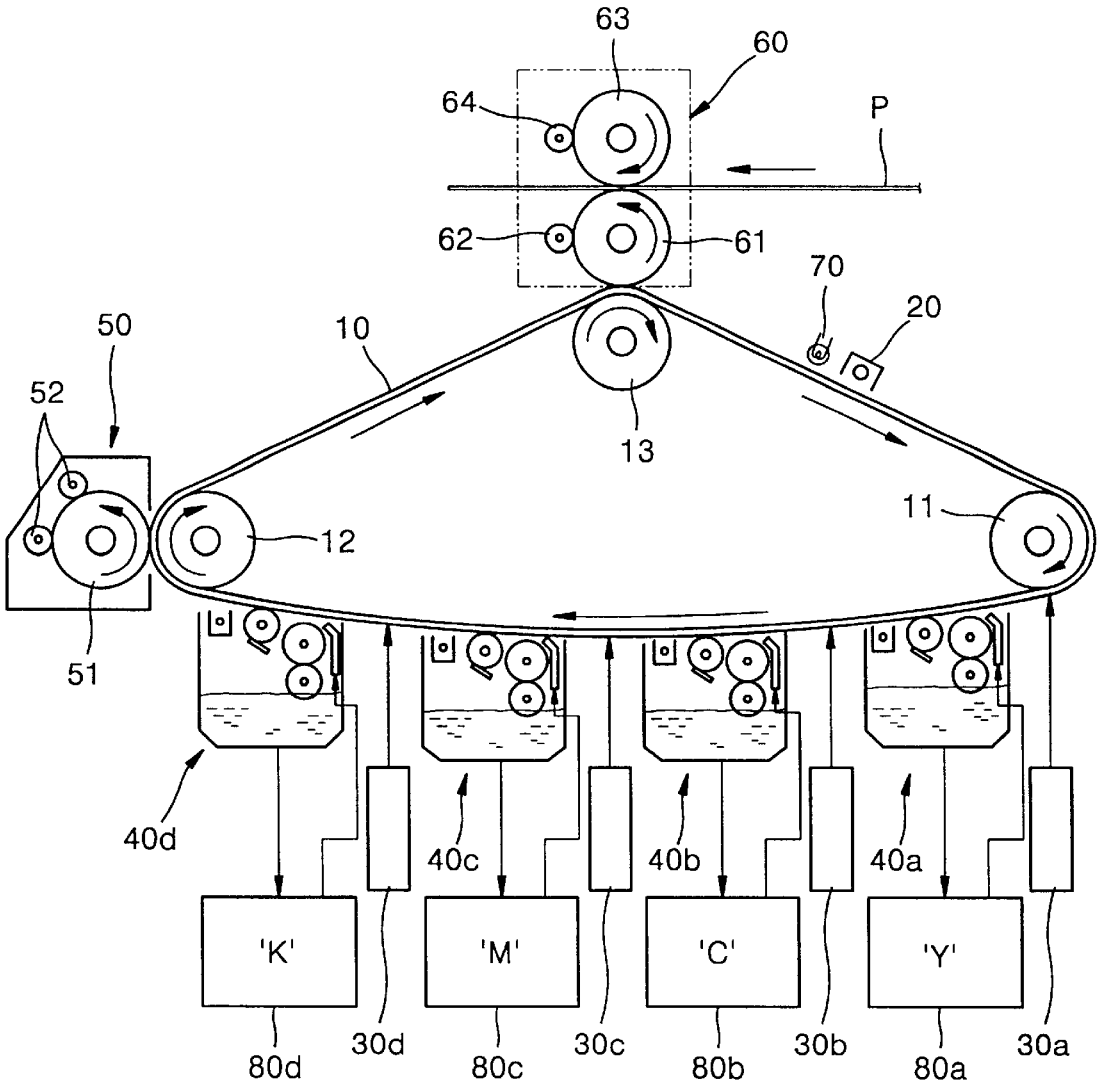
FIG. 1 (PRIOR ART)
FIG. 1 is a schematic diagram showing the main parts of a conventional liquid electrophotographic printer.
Figure 2:
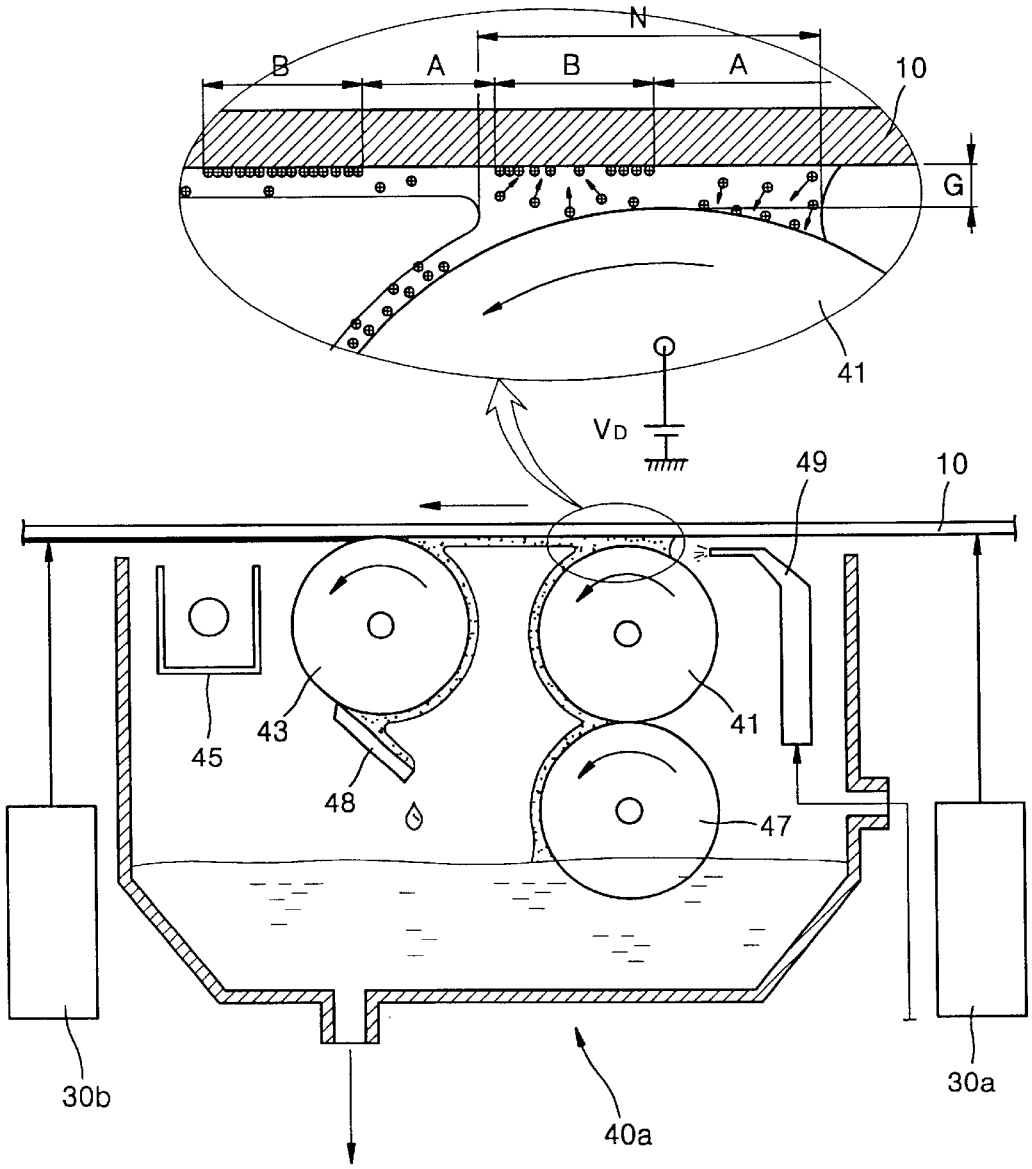
FIG. 2 (PRIOR ART)
FIG. 2 is a schematic diagram showing the inner structure and the development process of the development unit of FIG. 1.
Figure 4:
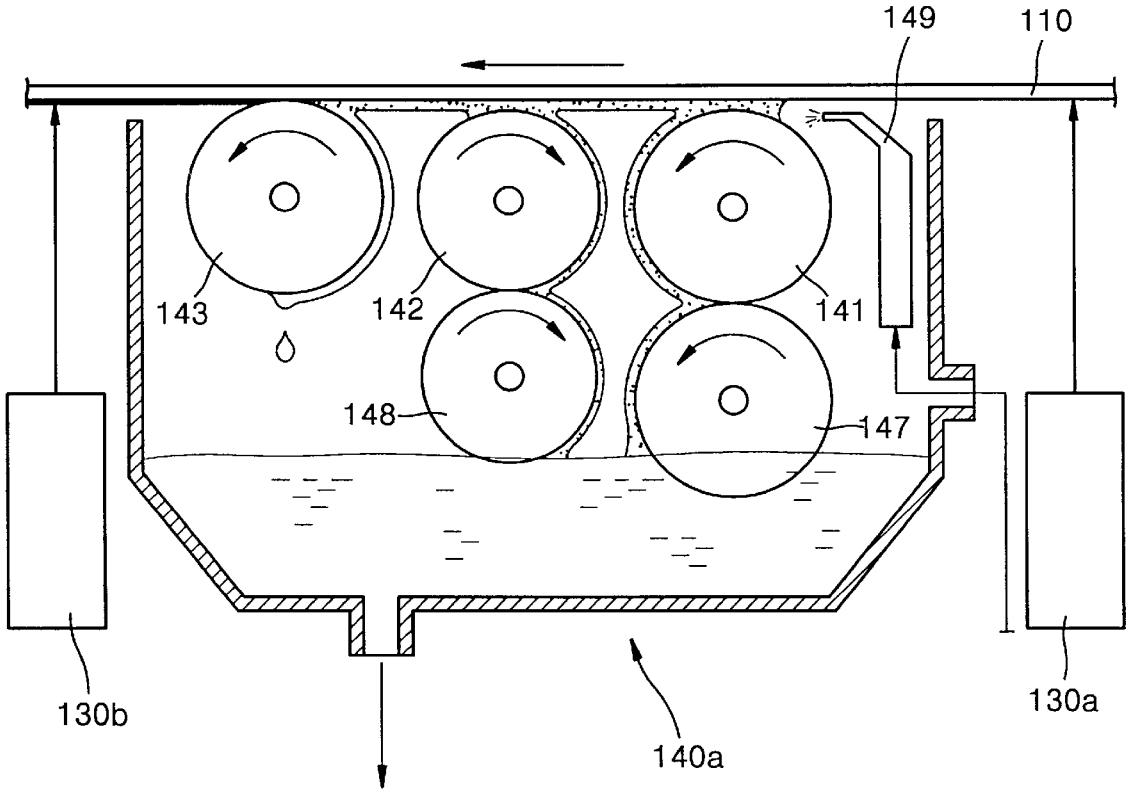
FIG. 4 is a schematic diagram showing the inner structure of the development unit of the liquid electrophotographic printer of FIG. 3 according to the present invention.

Referring to FIG. 4, three rollers including a developer roller 141*a*, a toner removal roller 142, and a squeeze roller 143 are installed in an upper portion of the Y-development unit 140*a*. The liquid electrophotographic printer according to the present invention employs the development system that uses three rollers. The developer roller 141 makes the toner particles of the ink to adhere to the latent electrostatic image region of the photoreceptor web 110 to develop the latent electrostatic image into a toner image. The toner removal roller 142 removes the toner from the liquid carrier layer adhering to a non-image region of the photoreceptor web 110. To this end, a predetermined voltage is applied to the toner removal roller 142. This will be described later. The squeeze roller 143*a* presses a portion of the photoreceptor web 110 in which the toner image is formed to squeeze excess liquid carrier from the portion. Also, a relatively high-voltage is applied to the squeeze roller 143 to charge the photoreceptor web 110 to a predetermined potential for the development of another color image. The squeeze roller 143 according to the present invention also performs the functions of the topping corona 45 (see FIG. 2) of the conventional liquid electrophotographic printer. To this end, at least the surface of the squeeze roller 143 is formed of a resistive material with a high resistance of $10^5$–$10^9$ Ω, preferably $10^6$ Ω. For example, the resistive material may be a synthetic material formed of urethane rubber and carbon.

As described above, although the development unit 140*a* of the liquid electrophotographic printer according to the present invention includes one more roller 141, 142, and 143 than the conventional development unit of a printer, there is no increase in the overall volume of the development unit 140*a* because there is no need to install the topping corona 45 (FIG. 2) therein.

An ink supply nozzle 149 is installed adjacent to the developer roller 141. The ink supply nozzle 149 serves to supply the ink contained in the ink reservoir 180*a* to the gap between the photoreceptor web 110 and the developer roller 141. Cleaning rollers 147 and 148 rotating in contact with the developer roller 141 and the toner removal roller 142 are installed underneath the developer roller 141 and the toner removal roller 142. The two cleaning rollers 147 and 148 remove the ink adhering to the surface of the development roller 141 and the toner removal roller 142, respectively. The cleaning rollers 147 and 148 are a cleaning means for cleaning the development roller 141 and the toner removal roller 142, and are replaced with blades (not shown) in an alternative embodiment. In another alternative embodiment, both the cleaning rollers 147 and 148 and a blade are utilized. Since no toner particles adhere to the squeeze roller 143, an additional cleaning means is not required for the squeeze roller 143.

Figure 5:
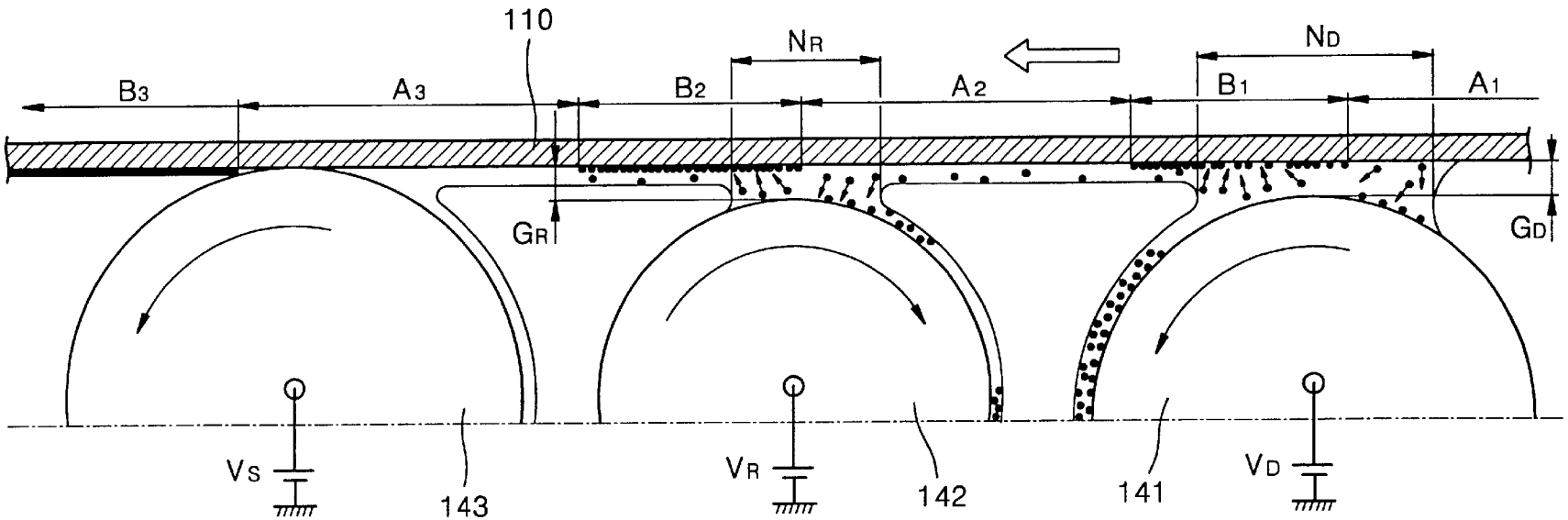
FIG. 5 is a schematic diagram showing the development unit of the liquid electrophotographic printer according to the present invention for describing the development system thereof in detail.

The development system of the liquid electrophotographic printer according to the present invention, which has the configuration described above, will be described with reference to FIGS. 5 and 6.

The photoreceptor web 110 is charged by the main charger 120 to a first potential of 500–600 volts, and preferably, about 550 volts. The Y-LSU 130*a* emits a beam onto the surface of the charged photoreceptor web 110 to form a latent electrostatic image corresponding to a yellow color image. The Y-LSU 130*a* selectively erases the potential of the surface of the photoreceptor web 110 to form the latent electrostatic image. Thus, a potential $V_{BY}$ (not shown) of an image region $B_1$, where the latent electrostatic image is formed, drops to a second potential of about 150 volts or less; for example, 100 volts. A potential $V_A$ (not shown) of a non-image region $A_1$ is kept at the first potential, i.e., 550 volts, charged by the main charger 120.

The latent electrostatic image is developed into a Y-toner image by the Y-development unit 140*a*. In particular, as the photoreceptor web 110 passes over the developer roller 141, Y-toner particles adhere to the image region $B_1$, in which the electrostatic latent image is formed, to form a Y-toner image. As a predetermined voltage is applied to the developer roller 141, the surface of the developer roller 141 is charged to a third potential $V_D$ of 300–400 volts, and preferably, about 350 volts. The third potential $V_D$ of the development roller 141 is determined to be lower than the first potential $V_A$ (550V) of the non-image region $A_1$ and to be higher than the second potential $V_{BY}$ (100V) of the image region $B_1$. It is preferable that the differences between the third potential $V_D$ and each of the first and second potentials $V_A$ and $V_{BY}$ are at least 100 volts or more, and preferably 200 volts or more. As the potential differences become greater, the affinity of toner particles to the photoreceptor web 110 and the developer roller 141 becomes more apparent. The developer roller 141 rotates in the circulation direction of the photoreceptor web 110 with a development gap $G_D$ of 100–200 $\mu$m from the photoreceptor web 110. As the ink containing Y-toner particles of about 2.5% solution by weight, contained in the Y-ink reservoir 180*a*, is supplied to the gap between the photoreceptor web 110 and the developer roller 141 by an ink supply means, i.e., by the ink supply nozzle 149, a nip ND as a liquid carrier film having about 6-mm width is formed between the photoreceptor web 110 and the developer roller 141.

The toner particles of the ink are charged to a positive potential and move in the nip $N_D$ as follows. The second potential $V_{BY}$ (100 volts) of the image region $B_1$ of the photoreceptor web 110 is lower than the third potential $V_D$ (350 volts) of the development roller 141, so that the toner particles move towards the image region $B_1$ and adhere to the image region $B_1$. The first potential $V_A$ (550 volts) of the non-image region $A_1$ is greater than the third potential $V_D$ (350 volts) of the developer roller 141, so that the toner particles move towards the developer roller 141 and adhere to the surface of the developer roller 141. Thus, the toner particles selectively adhere to only the image region $B_1$ charged to a relatively low potential, so that a toner image is formed therein. Excess ink and toner particles stuck to the surface of the rotating developer roller 141 are removed by the cleaning roller 147.

Figure 6:
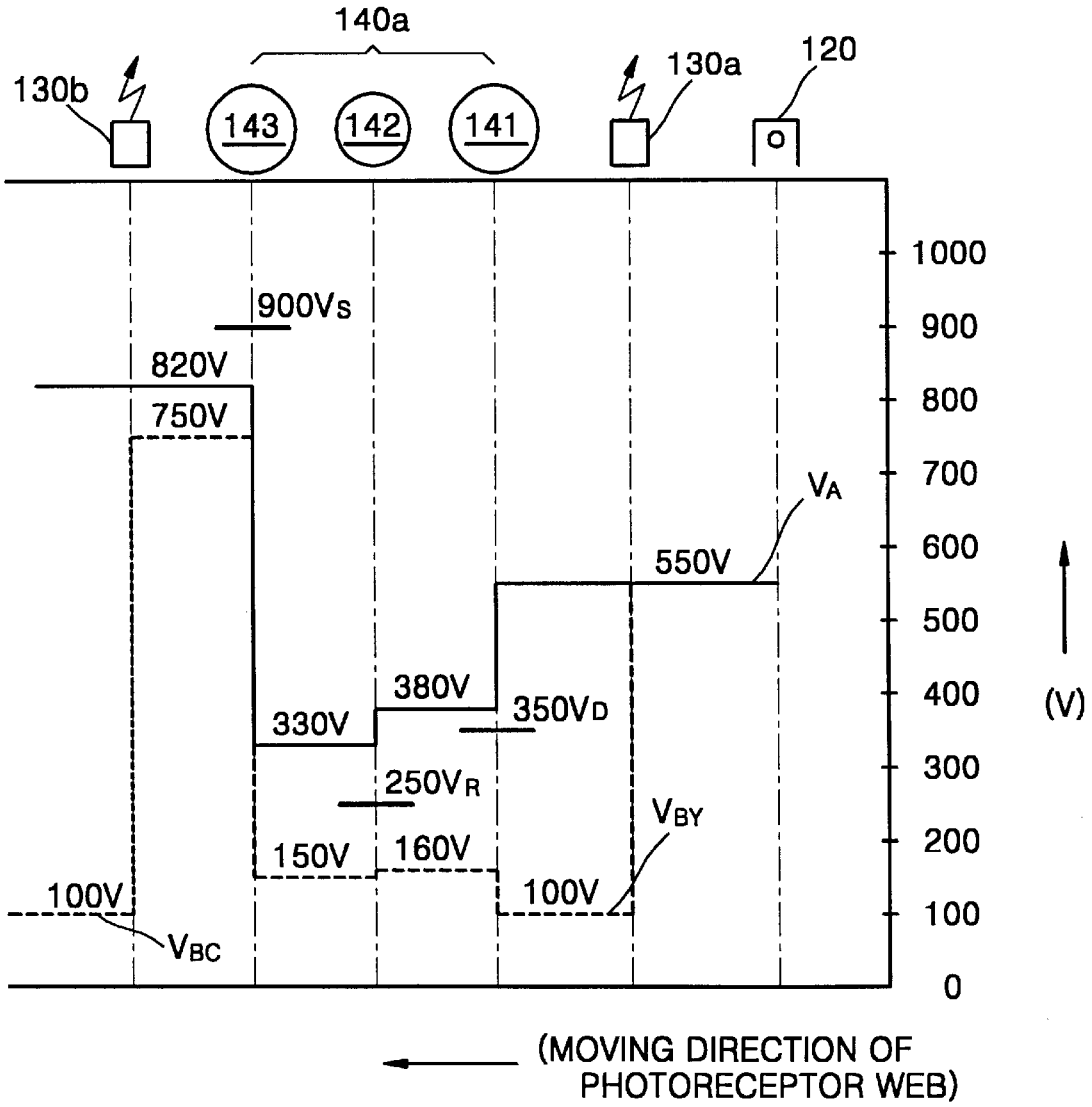
FIG. 6 is a schematic diagram showing the potential conditions and potential variations for the constituent elements of the development unit of the liquid electrophotographic printer according to the present invention.

In an image region $B_2$ of the photoreceptor web 110, which has passed the developer roller 141, a high-concentration ink layer and a liquid carrier film covering the ink layer are formed. Only the liquid carrier film exits in a non-image region $A_2$. However, even after the photoreceptor web 110 has passed the developer roller 141, toner particles of about 0.5% remain in the liquid carrier film. Once the image region $B_1$ and the non-image region $A_1$ of the photoreceptor web 110 pass the developer roller 141, due to the ink layer or the liquid carrier film existing in the image region $B_2$ and the non-image region $A_2$, the second potential $V_{BY}$ of the image region $B_2$ increases to about 160 volts and the first potential $V_A$ of the non-image region $A_2$ drops to about 380 volts, as shown in FIG. 6.

Next, when the photoreceptor web 110 passes the toner removal roller 142, the toner particles existing in the liquid carrier film adhering to the non-image region $A_2$ are removed, so that a toner-free liquid carrier film remains. In particular, as a voltage is applied to the toner removal roller 142, the surface of the toner removal roller 142 is charged to a fourth potential $V_R$ of about 250 volts. The fourth potential $V_R$ of the toner removal roller 142 is determined to be higher than the second potential $V_{BY}$ (160 volts) of the image region $B_2$ and to be lower than the first potential $V_A$ (380 volts) of the non-image region $A_2$. It is preferable that the difference between the fourth potential $V_R$ of the toner removal roller 142 and the first potential $V_A$ of the non-image region $A_2$ is at least 50 volts or more. The greater the potential difference, the easier the removal of the unnecessary toner particles from the liquid carrier film. The toner removal roller 142 is installed with a separation gap $G_R$ of 100–200 $\mu$m from the photoreceptor web 110, and a nip $N_R$ having a width of 1–3 mm is formed between the toner removal roller 142 and the photoreceptor web 110. The width of the nip $N_R$ may be adjusted according to the diameter of the toner removal roller 142 and the width of the gap $G_R$. The toner removal roller 142 may rotate in any direction. However, it is preferable that the toner removal roller 142 rotate in a direction opposite to the circulation direction of the photoreceptor web 110 for easier formation of the nip $N_R$.

The toner particles move in the nip $N_R$ formed between the photoreceptor web 110 and the toner removal roller 142 as follows. The first potential $V_A$ (380 volts) of the non-image region $A_2$ of the photoreceptor web 110 is higher than the fourth potential $V_R$ (250 volts) of the toner removal roller 142, so that the toner particles remaining in the liquid carrier film move toward the toner removal roller 142. The second potential $V_{BY}$ (160 volts) of the image region $B_2$ is lower than the fourth potential $V_R$ (250 volts) of the toner removal roller 142, so that the toner particles move toward the image region $B_2$ and adhere to the image region $B_2$. The toner particles and liquid carrier adhering to the surface of the rotating toner removal roller 142 are removed by the cleaning roller 148. When the photoreceptor web 110 passes through the toner removal roller 142, the second potential $V_{BY}$ of the image region $B_2$ and the first potential $V_A$ of the non-image region $A_2$ slightly change, as shown in FIG. 6.

The liquid carrier film is formed while the photoreceptor web 110 passes the Y-development unit 140*a*. Toner particles remaining in the liquid carrier film adhering to the non-image region $A_2$ can be almost completely removed by the toner removal roller 142, thereby resulting in a toner-free liquid carrier film in the non-image region $A_3$ passed through the toner removal roller 142. As a result, the problems caused by the conventional technique can be solved. In other words, the transfer of Y-toner particles remaining in the liquid carrier film to the next C-development unit 140*b* is prevented. Thus, the problem of the successive contamination of the C-, M-, and K-development units 140*b*, 140*c* and 140*d*, and the inks contained therein is solved. No toner particles exist in the non-image region of the photoreceptor web 110. Therefore, the problem of ink smearing in the non-image region of the print paper P is solved.

As the photoreceptor web 110 passes the squeeze roller 143, the developed toner image region of the photoreceptor web 110 is pressed by the squeeze roller 143, so that excess liquid carrier is squeezed from the toner image. In particular, the squeeze roller 143 rotates in the circulation direction of the photoreceptor web 110 in contact with the photoreceptor web 110 with a compression force of, for example, about 20 kgf. As a result, the liquid carrier covering the toner image formed in the image region $B_3$ of the photoreceptor web 110, and the liquid carrier adhering to the non-image region $A_3$ are mostly removed. When the photoreceptor web 110 has passed the squeeze roller 143, a toner image having about 50% toner particles is formed in the image region $B_3$ of the photoreceptor web 110.

As described above, the squeeze roller 143 can charge the photoreceptor web 110 to a predetermined potential to develop another color image. To this end, a relatively high voltage is applied to the squeeze roller 143 such that the surface of the squeeze roller 143 is charged to a fifth potential $V_S$ of about 800 volts or greater, and preferably, about 900 volts. At that exemplary value of $V_S$, the first potential $V_A$ of the non-image region $A_3$ of the photoreceptor web 110 passed through the squeeze roller 143 increases to about 820 volts and the second potential $V_{BY}$ of the image region $B_3$ increases to about 750 volts, as shown in FIG. 6. These potential levels may slightly vary depending on the property of the squeeze roller 143. When the surface of the squeeze roller 143 is charged to a high potential, the toner particles forming the toner image much more strongly adhere to the image region $B_3$ due to the repulsive force exerted between the squeeze roller 143 and the toner particles. Thus, although the toner image is compressed by the squeeze roller 143, the edge of the toner image does not spread and a part of the toner image does not stick to the surface of the squeeze roller 143.

After a Y-toner image is developed through the procedure above, the C-LSU 130*b* emits a beam onto the surface of the photoreceptor web 110 to develop another color image, i.e., a C-toner image, so that a latent electrostatic image corresponding to a cyan image is formed. The latent electrostatic image has a potential $V_{BC}$ of about 100 volts and is developed into a C-toner image in the same manner as described above.

When the four color images of Y, C, M, and K are sequentially developed, overlapping each other, as described above, a complete color image is formed in the photoreceptor web 110. This developed color image is dried by the drying unit 150 such that it can be appropriately transferred, and is transferred to the print paper P by the transfer unit 160.

To sequentially develop the overlapping four color toner images, the potential of the rollers of each of the development units 140*a*, 140*b*, 140*c*, and 140*d*, and the conductivity of the ink used in each of the development units 140*a*, 140*b*, 140*c*, and 140*d* should be appropriately adjusted, as shown in Table 1. The figures in Table 1 are obtained through many experiments performed by the present inventor, and thus a possible slight deviation above or below the levels should be considered. The potential and the ink conductivity illustrated in Table 1 may vary depending on the type and property of the photoreceptor web 110, ink, and rollers 141, 142 and 143.

TABLE 1

| Items | | Y-development Unit | C-development Unit | M-development Unit | K-development Unit |
|---|---|---|---|---|---|
| Ink Conductivity (pMho/cm) | | 80–150 | 70–150 | 100–200 | 80–200 |
| Non-image Region Potential ($V_A$) | $A_1$ | 550 | 820 | 890 | 900 |
| | $A_2$ | 380 | 510 | 590 | 700 |
| | $A_3$ | 820 | 890 | 900 | 1,100 |
| Image Region Potential ($V_B$) | $B_1$ | 100 | 100 | 100 | 100 |
| | $B_2$ | 160 | 320 | 340 | 410 |
| | $B_3$ | 750 | 810 | 780 | 950 |
| Development Roller Potential ($V_D$) | | 350 | 500 | 600 | 600 |
| Toner Removal Roller Potential ($V_R$) | | 250 | 450 | 500 | 500 |
| Squeeze Roller Potential ($V_s$) | | 900 | 1,000 | 1,000 | 1,300 |

As shown in Table 1, the conductivity of the inks is in the range of 70–200 pMho/cm. The conductivity of the ink is appropriately adjusted within the range depending on color.

The potential (third potential) of the developer roller is determined to be 200–300 volts lower than the potential (first potential) of the non-image region $A_1$ and 250–500 volts higher than the potential (second potential) of the image region $B_1$. The potential (fourth potential) of the toner removal roller is determined to be 60–200 volts lower than the potential of the non-image region $A_2$ and 90–100 volts higher than the potential of the image region $B_2$ of the photoreceptor web 110 passed through the developer roller.

As the photoreceptor web 110 sequentially passes the C-, M-, and K-development units so that the color toner images are formed overlapping one another, the difference in the potential between the non-image region and the image region decreases. In this case, it is difficult to appropriately set the third and fourth potentials. Thus, the potential (fifth potential) of the squeeze roller is determined to be relatively higher than the other potential levels at 900–1,300 volts. As a result, the first potential of a non-image region for the next color image becomes higher, thereby increasing the difference between the first potential and the second potential of adjacent image region. Thus, the selection range of the third and fourth potential levels, which are determined as a value between the first and second potential levels, becomes wider.

The above-listed ink conductivity and potential levels are exemplary of a smooth operation of the development system according to the present invention.

As described above, the liquid electrophotographic printer according to the present invention has the following advantages.

First, since the toner particles are removed from the liquid carrier film adhering to the non-image region by the toner removal roller 142, contamination of a next development unit and another color ink by the transfer of toner particles of a certain color to the development unit is prevented. No toner particles remain in the non-image region of the photoreceptor web 110, so that the non-image region of print paper P is not smeared with the toner particles.

Second, the toner image is formed by the high-voltage squeeze roller 143, so that the toner particles strongly adhere to the image region of the photoreceptor web 110. As a result, even after the toner image is compressed by the squeeze roller 143, the edge of the toner image does not spread and a part of the toner image does not stick to the surface of the squeeze roller 143. A smearing of the toner image or an offset of overlapping of different color images is suppressed.

Due to these advantages, the quality of the printed color image is improved.

While this invention has been particularly shown and described with reference to exemplary embodiment(s) thereof, it will be understood by those skilled in the art that various changes in form and details may be made therein without departing from the spirit and scope of the invention as defined by the appended claims.

What is claimed is:

1. A liquid electrophotographic printer comprising:

a photoreceptor web circulating around a continuous path, having a non-image region charged by a main charger to a first potential and an image region in which a latent electrostatic image is formed by a laser scanning unit to have a second potential, wherein the second potential is lower than the first potential;

a development unit for developing the latent electrostatic image using an ink in which toner particles of a predetermined color are dispersed in a liquid carrier;

a drying unit for drying a developed toner image; and a transfer unit for transferring a dried image to a print paper, wherein the development unit comprises:

a developer roller rotatably installed with a predetermined separation gap from the photoreceptor web, for forming the toner image by attaching the toner particles of the ink to the image region;

a toner removal roller rotatably installed with a predetermined separation gap from the photoreceptor web, for removing toner particles remaining in a liquid carrier film adhering to the non-image region by moving said toner particles toward said toner removal roller; and a squeeze roller rotatably installed in contact with the photoreceptor web, for squeezing the liquid carrier out of the toner image by compressing the toner image, and wherein a surface of the squeeze roller is charged to a fifth potential in the range of 900–1300 volts to charge the photoreceptor web.

2. The liquid electrophotographic printer of claim 1, wherein a plurality of development units are arranged in series such that toner images of different colors are sequentially formed.

3. The liquid electrophotographic printer of claim 2, wherein the different colors include yellow, cyan, magenta, and black.

4. The liquid electrophotographic printer of claim 1, wherein the surface of the developer roller is charged to a third potential whose level is between the first and second potentials.

5. The liquid electrophotographic printer of claim 4, wherein the third potential is at least 100 volts lower than the first potential.

6. The liquid electrophotographic printer of claim 1, wherein the surface of the toner removal roller is charged to a fourth potential whose level is between the potential of the non-image region passed through the developer roller and the potential of the image region passed through the developer roller.

7. The liquid electrophotographic printer of claim 6, wherein the fourth potential is at least 50 volts lower than the potential of the non-image region passed through the developer roller.

8. A method of forming an electrophotographic image comprising:

circulating a photoreceptor web in a continuous path;

charging a non-image region of the photoreceptor web to a first potential with a charger;

scanning an image region of the photoreceptor web to a second potential lower than the first potential with a laser scanning unit, thereby creating a latent electrostatic image;

developing the latent electrostatic image with a developing unit using an ink having toner particles of a predetermined color dispersed in a liquid carrier therein;

drying the developed toner image with a drying unit; and transferring the dried image to a print paper, wherein the development unit comprises:

a developer roller rotatably installed with a predetermined separation gap from the photoreceptor web, for forming the toner image by attaching the toner particles of the ink to the image region;

a toner removal roller rotatably installed with a predetermined separation gap from the photoreceptor web, for removing toner particles remaining in a liquid carrier film adhering to the non-image region by moving said toner particles toward said toner removal roller; and a squeeze roller rotatably installed in contact with the photoreceptor web, for squeezing the liquid carrier out of the toner image by compressing the toner image and for charging the photoreceptor web to a predetermined potential for developing a color image of the electrophotographic image.

9. The liquid electrophotographic printer of claim 1, wherein each of the developer roller and the toner removal roller is installed with a separation gap of 100–200 $\mu$m from the photoreceptor web.

10. The liquid electrophotographic printer of claim 1, wherein the toner removal roller rotates in a direction opposite to a circulation direction of the photoreceptor web.

11. The liquid electrophotographic printer of claim 1, wherein a level of the fifth potential is higher than a level of the first potential.

12. The liquid electrophotographic printer of claim 11, wherein at least the surface of the squeeze roller is formed of a resistive material.

13. The liquid electrophotographic printer of claim 12, wherein the resistive material has a resistance of $10^5$–$10^9$ Ω.

14. The liquid electrophotographic printer of claim 1, wherein a cleaning means for cleaning the surface of each of the developer roller and the toner removal roller are installed in the development unit.

15. The liquid electrophotographic printer of claim 1, wherein the ink has a conductivity of 70–200 pMho/cm.

16. The liquid electrophotographic printer of claim 15, wherein an ink of yellow color has a conductivity of 80–150 pMho/cm, an ink of cyan color has a conductivity of 70–150 pMho/cm, an ink of magenta color has a conductivity of 100–200 pMho/cm, and an ink of black has a conductivity of 80–200 pMho/cm.

17. The liquid electrophotographic printer of claim 6, wherein the fourth potential is in the range of 160–380 volts.

18. The liquid electrophotographic printer of claim 1, wherein the toner removal roller moves the toner particles adjacent to the non-image region towards the toner removal roller and moves toner particles adjacent to the image region toward the image region.

19. The liquid electrophotographic printer of claim 1, wherein the development unit further comprises:

a first cleaning roller for cleaning the surface of the developer roller; and a second cleaning roller for cleaning the surface of the toner removal roller.

20. The liquid electrophotographic printer of claim 1, wherein the fifth potential is greater than 800 volts.

* * * * *